US009188415B2

(12) United States Patent
Pfaff et al.

(10) Patent No.: US 9,188,415 B2
(45) Date of Patent: Nov. 17, 2015

(54) DEVICE AND METHOD FOR AIRTIGHT COVERING OF A TRACER OR THE LIKE

(75) Inventors: Andreas Pfaff, Zurich (CH); Philipp Bucheli, Schafisheim (CH); Karlheinz Fehrenbach, Kuessaberg (DE)

(73) Assignee: RWM Schweiz AG, Zurich (CH)

( * ) Notice: Subject to any disclaimer, the term of this patent is extended or adjusted under 35 U.S.C. 154(b) by 0 days.

(21) Appl. No.: 13/452,027

(22) Filed: Apr. 20, 2012

(65) Prior Publication Data

US 2012/0312148 A1 Dec. 13, 2012

(30) Foreign Application Priority Data

Apr. 21, 2011 (DE) ..... 10 2011 018 475

(51) Int. Cl.
*F42B 12/38* (2006.01)
*F42B 33/00* (2006.01)

(52) U.S. Cl.
CPC ..... *F42B 12/38* (2013.01); *F42B 33/001* (2013.01)

(58) Field of Classification Search
CPC ..... F42B 10/40; F42B 10/44; F42B 12/78; F42B 12/74; F42B 12/38; F42B 12/44
USPC ..... 86/55, 23; 102/473, 364, 490, 513
See application file for complete search history.

(56) References Cited

U.S. PATENT DOCUMENTS

| | | | | | |
|---|---|---|---|---|---|
| 2,336,143 | A * | 12/1943 | Werme | 86/55 |
| 2,394,249 | A | 2/1946 | McGahey, Jr. | |
| 2,402,018 | A * | 6/1946 | Burdett | 86/23 |
| 3,291,049 | A * | 12/1966 | Hitchens | 102/513 |
| 4,129,061 | A * | 12/1978 | Bedall et al. | 86/20.12 |
| 4,353,302 | A * | 10/1982 | Strandli et al. | 102/364 |
| 4,468,846 | A | 9/1984 | Rossmann | |
| 4,807,535 | A * | 2/1989 | Schilling et al. | 102/490 |
| 4,987,672 | A | 1/1991 | Honda et al. | |
| 5,186,592 | A * | 2/1993 | Budenbender | 413/2 |
| 5,848,616 | A | 12/1998 | Vogel et al. | |
| 6,796,244 | B2 * | 9/2004 | Loubser | 102/473 |
| 2003/0205161 | A1 * | 11/2003 | Roach | 102/481 |
| 2008/0196617 | A1 * | 8/2008 | Riess et al. | 102/513 |

FOREIGN PATENT DOCUMENTS

| | | | |
|---|---|---|---|
| DE | 361 070 | A | 10/1922 |
| DE | 707 002 | A | 6/1941 |
| DE | 76 28 540 | U1 | 3/1977 |
| DE | 44 15 341 | A1 | 11/1995 |
| DE | 195 13 992 | A1 | 10/1996 |
| DE | 10 2009 027 146 | A1 | 12/2010 |
| EP | 0 072 050 | A1 | 2/1983 |
| EP | 0 180 515 | A1 | 5/1986 |
| EP | 0 398 025 | A1 | 11/1990 |

* cited by examiner

*Primary Examiner* — Samir Abdosh
*Assistant Examiner* — John D Cooper
(74) *Attorney, Agent, or Firm* — Muncy, Geissler, Olds & Lowe, P.C.

(57) ABSTRACT

A part of a cover is pressed radially into a circumferential groove contour in a projectile body by a preferably rigid die, which need only be moved axially and which is provided with a special outer contour. An outer contour should be matched to the groove contour or vice versa, so that the material of the cover that is formed radially by the forward-moving die can be pressed into the groove contour of the projectile body, and the cover no longer has any degrees of freedom after the forming, so that it is secured with respect to the tracer or the like. The cover is preferably a cover ring.

14 Claims, 2 Drawing Sheets

DEVICE AND METHOD FOR AIRTIGHT COVERING OF A TRACER OR THE LIKE

This nonprovisional application claims priority under 35 U.S.C. §119(a) to German Patent Application No. DE 10 2011 018 475.9, which was filed in Germany on Apr. 21, 2011, and which is herein incorporated by reference.

BACKGROUND OF THE INVENTION

1. Field of the Invention

The invention relates to a device and a method for the covering of, for example, a tracer or the like, which in general is located in the base part of a projectile body, and relates to the concept that the tracer or similar contents must be sealed in an airtight manner because the moisture, etc., that would otherwise enter can have the result that, for example, the tracer pyrotechnic material no longer burns or burns inadequately. To this end, a method is proposed in which a cover, preferably a cover ring, is pressed radially into a groove contour of the projectile body, which preferably extends continuously around the circumference, during the forming process by an axial advance motion of a (rigid) die, preferably made of metal. The die has an outer diameter that depends on the axial position of the die relative to that of the cover.

2. Description of the Background Art

In practice, provision is made for an airtight seal to be implemented by means of a cover disk, etc., generally made of brass. This is secured in place by additional parts, such as, e.g., a cover ring. In this design, the cover ring is retained by forming of the material of the projectile body, for example. Other solutions are known along the lines of an additional screw or nut being screwed into the base part of the projectile body.

The disadvantage of forming resides in that, among other factors, contradictory demands are often placed on the projectile body material. Material properties that are hard or exhibit little or no deformability are a precondition for final ballistic effectiveness, while soft or ductile material properties are the precondition for the forming process such as crimping, peening, etc. Therefore, the region of the projectile body material that is to be formed is converted into a soft or ductile state by the application of heat treatment methods; however, this is very complicated and is both cost-intensive and time-intensive. Moreover, process stability must be maintained at great effort. The formation of cracks in the material, which can arise during hardening or forming, cannot be prevented even by the heat treatment method that follows or that has preceded the forming process, and can, as potential failure sources, result in the failure of the cover. In contrast, screws and nuts need only be subjected to a surface treatment, for example hard anodizing, but the effort at assembly is greater, as measures for securing the screws are necessary. Guide surfaces for improved assembly require a commensurate installation space. Moreover, the weight of a screwed connection for covering the tracer is greater than that of a cover ring.

SUMMARY OF THE INVENTION

It is therefore an object of the invention to provide a device and a method that permit improved covering of the tracer.

The invention is based on the idea of deforming the cover itself rather than the projectile body material. To this end, a part of the cover is pressed radially into a circumferential groove contour in the projectile body material by a preferably rigid die, which need only be moved axially and which is provided with a special outer contour. In this design, the outer contour should be matched to the groove contour (or vice versa), so that the material of the cover that is formed radially by the forward-moving die can be pressed into the groove contour of the projectile body, and the cover no longer has any degrees of freedom after the forming, so that it is secured with respect to the tracer or the like. The cover is preferably a cover ring.

Since the cover is deformed radially outward from the inside, it is pressed against the projectile body by the acceleration, inertial, and centrifugal forces arising when the projectile is fired, so that no parts that fly off are produced. The positioning of the cover by means of a preferably rigid die guarantees high process stability, which is a prerequisite for the safety requirements in order to prevent the occurrence of parts that fly off due to defects in the forming process or inadequate heat treatment.

Moreover, this idea can be applied independently of the properties of the projectile body material, and permits a maximum degree of flexibility with regard to the materials to be used for the projectile body.

The manufacturing process, which is now simpler, has a stable process, and optimizes costs and time since there is a reduction in the number of individual work steps as well as a reduction in the technical requirements for production itself. Potential defects, such as inadequate deformation of the cover or incorrect seating, can also be detected easily by visual inspection.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
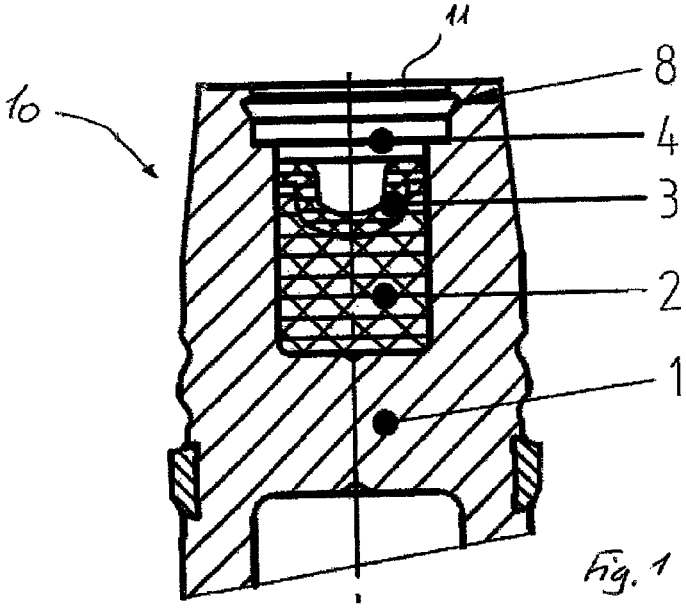
FIGS. 1-3 illustrate method steps for covering a tracer, according to an embodiment.

FIG. 1 shows a simplified representation of the basic principle of the method. A base part of a projectile 10 is labeled as 1, wherein the base part 1 accommodates a tracer 2, 3 in a bore 11. The tracer 2, 3 in turn comprises a tracer pellet 2 and an ignition charge 3, which preferably are pressed into the bore 11. In this case, the tracer 2, 3 has pyrotechnic substances, which react with other chemical substances such as are contained in propellant charge powder. A cover disk 4 serves to seal the tracer 2, 3 with respect to the environment until the point in time when the projectile 10 is fired from a weapon that is not shown in detail, in order to prevent contact between the substances and damp air, etc. The cover disk 4 is secured in the base part 1 by a cover ring 6.

Figure 3:
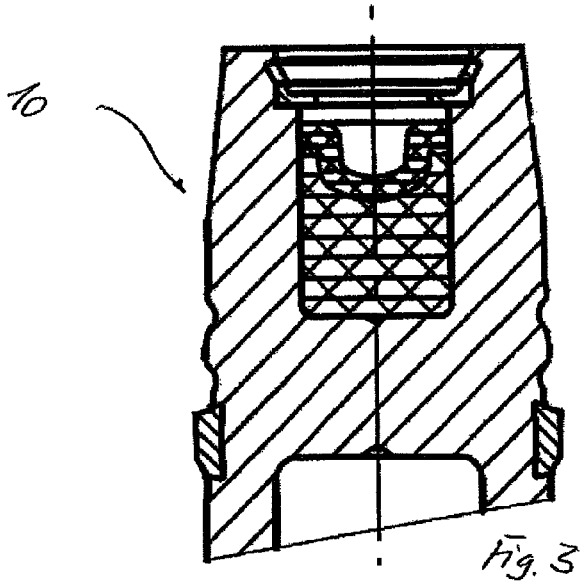
Figure 2:
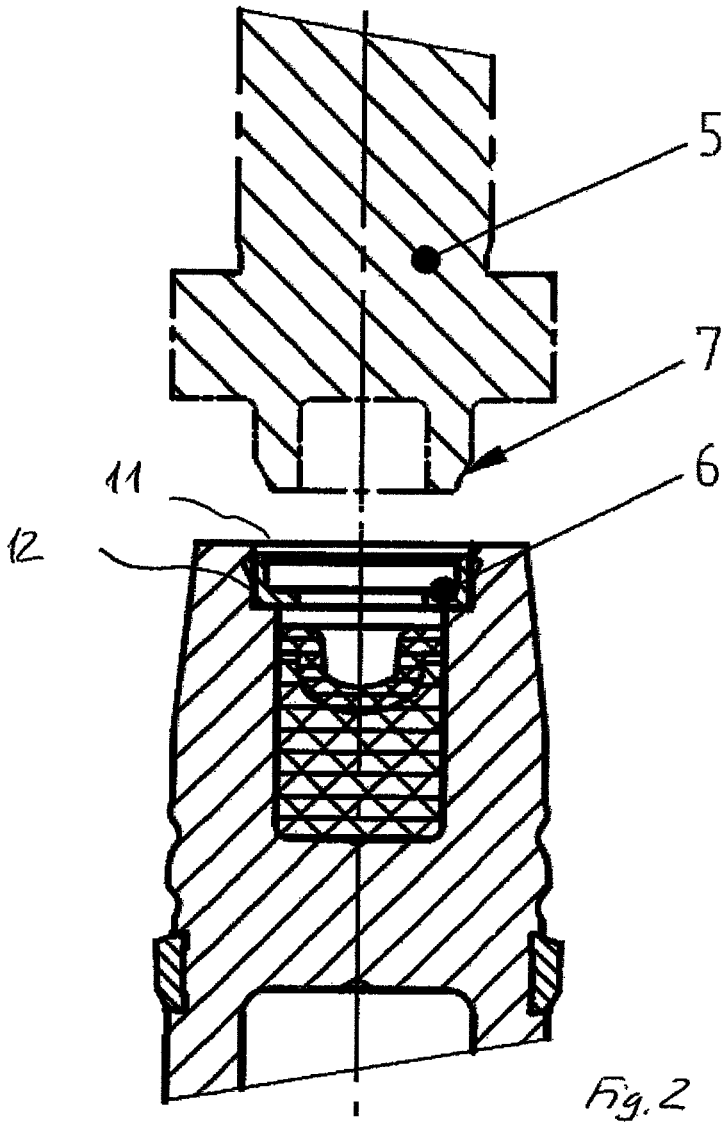

After conventional pressing-in of the tracer 2, 3, the cover disk 4 and the cover ring 6 are placed in the opening 12 provided for this purpose in the projectile body 10, as shown in FIG. 2. Next, the cover ring 6 is pressed into the bore 11 of the base part 1 of the projectile body 10 (FIG. 2) with a die 5, preferably made of metal, wherein the die 5, in its forward motion or axial motion and on account of its (special) outer contour 7, deforms the cover ring 6 into the preferentially circumferential groove 8 in the projectile body or base part 1. After the pressing of the cover ring 6 including the cover disk 4, the covering of the tracer 2, 3 in the bore 11 with respect to the environment is ensured, and the forming process is ended (FIG. 3).

Figure 4:
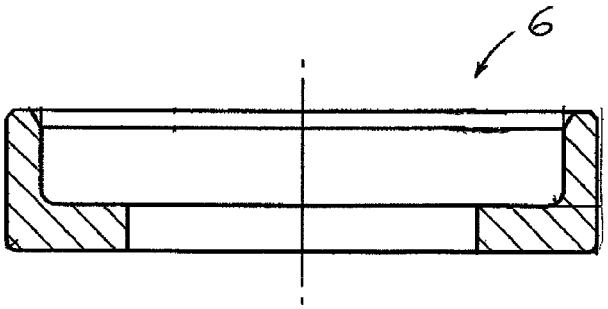
FIG. 4 illustrates a cross-sectional representation of the cover ring from the other figures.

FIG. 4 shows a cross-sectional view of a cover 6, which preferably is designed as a cover ring. This secures the cover disk 4.

Alternatively, the cover disk 4 and the cover ring 6 can also constitute a one-piece construction unit.

It is a matter of course that this method is not limited to sealing a tracer in the base part 1 of a projectile 10. Thus, other components that are located in a bore or cavity in a projectile, a munition, etc., can also be sealed securely in a simple manner using this method. In this context, bore is also understood to mean cavities, recesses, openings, or the like in projectile bodies, munition bodies, etc.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projectile fastening assembly comprising:

a ring-shaped cover;

a projectile having a bore with a tracer incorporated therein, the bore including a groove;

a disk-shaped cover positioned between the ring-shaped cover and the tracer, such that the entire tracer is positioned to a first side of the disk-shaped cover and the entire ring-shaped cover is positioned to a second side of the disk-shaped cover that opposes the first side; and a device for fastening the ring-shaped cover in the bore, the device comprising a die having an outer contour that is dimensioned to correspond to an opening of the bore, such that during axial movement of the device, the ring-shaped cover is deformed and pressed into the groove provided in the bore, such that the disk-shaped cover is secured within the bore by the ring-shaped cover, wherein the tracer includes an ignition charge and a tracer pellet and wherein the disk-shaped cover directly contacts the ignition charge.

2. The projectile fastening assembly according to claim 1, wherein the groove is circumferential.

3. The projectile fastening assembly according to claim 2, wherein the groove is continuous around the circumference.

4. The projectile fastening assembly according to claim 1, wherein the die is made of a rigid material.

5. The projectile fastening assembly according to claim 4, wherein the die is made of metal.

6. The projectile fastening assembly according to claim 1, wherein the groove has a larger circumference than the bore.

7. The projectile fastening assembly according to claim 6, wherein the groove is tapered.

8. The projectile fastening assembly according to claim 1, wherein the ring-shaped cover is discrete from the projectile.

9. The projectile fastening assembly according to claim 1, wherein the groove is closer to the opening of the bore than the disk-shaped cover and the tracer.

10. The projectile fastening assembly according to claim 1, wherein the opening has a larger circumference than the groove.

11. A method for sealing a bore in a projectile with the aid of a ring-shaped cover, the method comprising:

incorporating a tracer and a disk-shaped cover in the bore, the bore including a groove; after incorporating the tracer and the disk-shaped cover in the bore, placing the ring-shaped cover into an opening of the bore; and pressing the ring-shaped cover into the groove provided in the bore of the projectile via a die having an outer contour that is dimensioned to correspond to the opening of the bore, so that the ring-shaped cover is deformed and pressed into the groove, such that the disk-shaped cover is secured within the Pare by the ring-shaped cover, wherein the disk-shaped cover is positioned between the ring-shaped cover and the tracer, such that the entire tracer is positioned to a first side of the disk-shaped cover and the entire ring-shaped cover is positioned to a second side of the disk-shaped cover that opposes the first side, and wherein the tracer includes an ignition charge and a tracer pellet and wherein the disk-shaped cover directly contacts the ignition charge.

12. The method according to claim 11, wherein the die is moved in the axial direction of the bore.

13. The method according to claim 11, wherein the tracer is pressed into the bore before the ring-shaped cover is deformed.

14. The method according to claim 11, wherein the ring-shaped cover is discrete from the projectile.

* * * * *